United States Patent [19]

Eichenberger et al.

[11] 4,185,810

[45] Jan. 29, 1980

[54] DEVICE FOR COOLING LONG ITEMS OF MATERIAL WHICH HAVE BEEN HEATED

[75] Inventors: Walter Eichenberger, Sierre; Bernhard Hilge, Mettmenstetten, both of Switzerland

[73] Assignee: Swiss Aluminium Ltd., Chippis, Switzerland

[21] Appl. No.: 939,097

[22] Filed: Sep. 1, 1978

[30] Foreign Application Priority Data

Sep. 5, 1977 [CH] Switzerland ..... 10827/77

[51] Int. Cl.[2] ..... F27D 9/00

[52] U.S. Cl. ..... 266/259; 34/135; 62/62; 62/381; 148/11.5 A; 432/80; 432/242; 432/244

[58] Field of Search ..... 266/259, 260; 34/135–139, 236, 240; 148/11.5 A; 432/80, 242, 244; 62/62, 381

[56] References Cited

U.S. PATENT DOCUMENTS

| | | | |
|---|---|---|---|
| 2,115,753 | 3/1938 | Talbot | 62/62 |
| 2,791,889 | 5/1957 | Childers | 62/381 |
| 2,880,598 | 4/1959 | Virden et al. | 62/381 |
| 3,142,546 | 7/1964 | Coats | 34/137 |
| 3,576,080 | 4/1971 | Bliemeister et al. | 34/135 |

FOREIGN PATENT DOCUMENTS

| | | | |
|---|---|---|---|
| 51-38210 | 3/1976 | Japan | 266/259 |

*Primary Examiner*—L. Dewayne Rutledge
*Assistant Examiner*—Michael L. Lewis
*Attorney, Agent, or Firm*—Bachman and LaPointe

[57] ABSTRACT

An improved apparatus for cooling heated metal items such as extrusion billets, and in particular billets of aluminum alloys is disclosed. The apparatus comprises a cooling chamber, means for transporting individual billets into and out of the cooling chamber, and inlet and outlet openings for the ingress and egress of a cooling medium from said chamber. A fan or the like is employed to produce a flow of air through the cooling chamber.

20 Claims, 4 Drawing Figures

A1
A2
B
C
Pos.1
Pos.2
Pos.3
Pos.4
Pos.5
1
2
3
4
5
6
7
8
9
10
11
13
14
15
16
19
20
21
24
25
26
27
28
29
32
33
34
35
37
38
a
b

FIG. 3
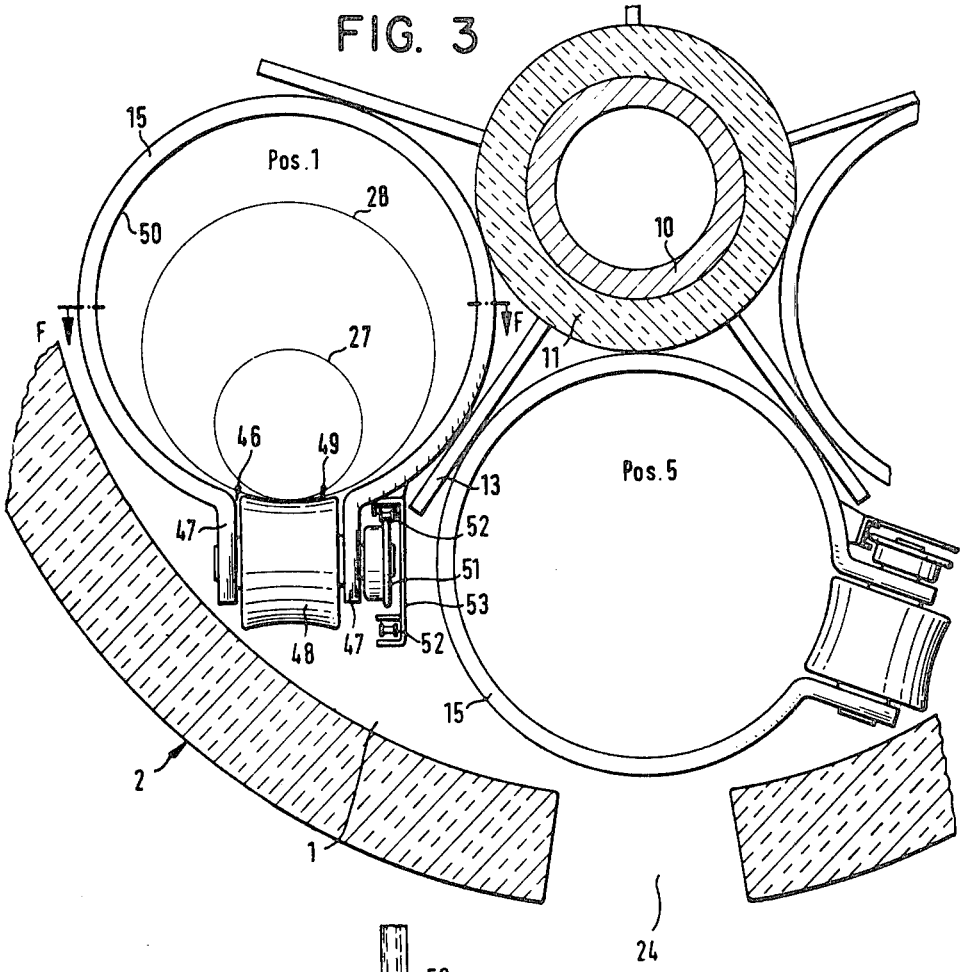
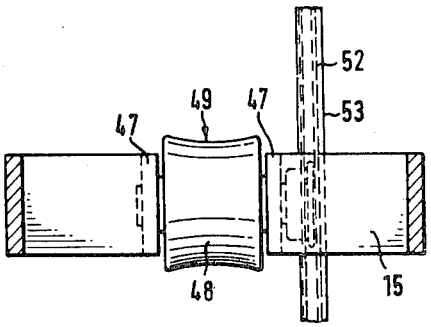
FIG. 4

DEVICE FOR COOLING LONG ITEMS OF MATERIAL WHICH HAVE BEEN HEATED

BACKGROUND OF THE INVENTION

The present invention relates to an apparatus for controllably cooling metal items such as billets or the like and, in particular billets of aluminum alloys.

There are a number of processes which require that aluminum alloys be heat treated prior to extrusion. After heat treatment, e.g., homogenizing and/or heterogenizing, and prior to extrusion the alloys are cooled in a controlled manner. The object of the heat treatment and controlled cooling process is to modify the structure of the alloy in some desired manner in order to make subsequent extrusion easier. In addition, the process improves the mechanical properties of the extruded section as well as its surface quality.

The object of the present invention is to provide an improved apparatus which achieves a controlled cooling of each single item of material taking into account the dimensions of the item and its composition. The apparatus is capable of controlling the cooling rate and cooling time of the item, thus allowing constant quality to be achieved in each piece of material treated.

SUMMARY OF THE INVENTION

The apparatus of the present invention comprises a cooling chamber which has inlet and outlet openings for a cooling medium, and is provided with a transport facility by means of which individual items of material are loaded into the chamber and transported inside the chamber. The transport facility is in the form of a rotatable shaft positioned centrally in the cooling chamber. The transport facility comprises a plurality of groups of supports disposed radially of the shaft for supporting the material uniformly along the length of the shaft and around the axis thereof. The radially disposed groups of supports are aligned along the length of the shaft in series so that each group can accommodate an item of material.

The supports are preferably in the form of rings with the material being treated being received in the rings, these rings preferably being circular in shape. The cooling chamber itself is preferably provided with a thermally insulating lining.

The transport facility, the speed of which is adjustable as known in the art, is used to move the material being treated inside the cooling chamber. By changing the speed of rotation of the transport facility the length of time the material spends in the cooling chamber is controlled thereby regulating the cooling process.

In addition, the process can be further and independently controlled by varying the amount of coolant passed through the chamber.

By positioning the inlet and outlet openings for the cooling medium in the lower and upper parts of the cooling chamber respectively, the heating of the cooling medium by the material as the medium flows past the material produces a natural draught of coolant which, under certain operating conditions and suitable size of the inlet and outlet openings, can effect an adequate throughput of coolant and thus sufficiently cool the material to a desired temperature within the necessary time interval to produce the metallurgical transformations desired.

If the natural draught as produced above is insufficient to maintain the necessary throughput of coolant, fan or blower means can be employed in the inlet and/or outlet openings to provide the necessary throughput of cooling medium. The fan can be regulated, e.g., continuously or by means of intermittent switching on and off, so as to regulate coolant flow.

If the natural draught is too strong and consequently the desired temperature is reached too quickly thus not allowing the desired metallurgical transformations to occur, the openings, preferably the outlet openings, can be provided with flaps, sliding doors or the like so as to reduce the throughput of cooling medium in a controllable manner.

The blowers and reduction flaps, sliding doors or the like can be employed so that all conceivable situations in production, including changes in the charge to be cooled and therefore the heat content to be extracted, can be taken into consideration.

The reduction flaps, sliding doors and the like are preferably adjustable so that, in addition to controlling the coolant stream via one or more blowers, there is an additional means of regulation, which makes possible to match the amount of coolant stream to the production conditions and the magnitude of heat to be extracted from the charge.

The apparatus of the present invention is particularly suited for all lengths of cast ingots which are to be divided up at a later stage to form extrusion billets. It has been found in practice that under the same cooling conditions, ingots of smaller diameter cool faster than ingots of larger diameter. In these instances, if the cooling time is too short, the desired metallurgical changes cannot take place. In such cases the stream of coolant in the apparatus of the present invention can be reduced by adjustment of the reduction flap, sliding door or the like. If the cooling time to a given temperature is too long, such as in the case of large diameter ingots, the throughput of cooling medium can be increased by switching on the blowers.

Thus, by choosing one of the described methods of controlling the throughput of the cooling medium, or by combining them, the exact rate of cooling can be achieved as required for each alloy, ingot dimensions or subsequent treatment. To effect the cooling, the inlet and outlet openings in the cooling chamber preferably connect up with the surrounding atmosphere. This is extremely economic and, as far as cooling efficiency is concerned, quite satisfactory. However, if desired, a closed circuit of air, e.g., with a heat exchanger can be used to keep the temperature of the cooling medium and its moisture content as constant as possible over a long period.

The inlet for the cooling medium can be in the form of a slit along the underside of the cooling chamber. When the shape of the inlet is such, the slit can be used as a recess to accommodate a set of rollers which can be raised and lowered. At least some of the rollers are power driven to feed the items to be treated into the rings which are arranged in groups in line with each other. The loading of the rings takes place via a door provided at the end in front of the station for loading the chamber, the set of rollers being raised above the lowest point of the inner circumference of the rings. When the item has entered the cooling chamber via the door and reached the first power driven roller, it is conveyed further into the chamber on the rollers, and after it is completely inside the chamber the item is stopped and the set of rollers lowered, so that the item comes to rest at the lowest part of the inner circumference of the set of aligned rings. After the door has been closed, the shaft begins to rotate taking the item with it in a circular movement about the shaft. If the item being treated, e.g., an extrusion billet, can roll, as is normal with round extrusion billets, then it rolls under its own weight and always occupies the lowest position in the rings. This ensures uniform cooling and prevents bending of the billet under the influence of its own weight or due to non-uniform cooling. In order that the length of ingots can be readily introduced into the support rings, the rings are larger in inner diameter than the largest diameter ingot to be cooled. Consequently, by rolling in the support rings during the rotation of the shaft, the ingot lengths turn around more than once. Ingots of smaller cross section may make up to two or more revolutions. This is particularly favorable as the smaller diameter ingots tend to warp more than the larger ingots.

After the billet has been cooled and reached the loading position again, it can be removed from the chamber either through the same door or through another door at the opposite end of the chamber.

In a modified version of the device according to the present invention, each ring can be provided with a slit in which a revolving roller is mounted with its axis perpendicular to the axis of the ring and has an outer face which is appropriately curved to be in line with the inner face of the ring. This modification makes a special coordinated set of rollers superfluous. The rollers mounted on the rings may be power driven or not and, in the case of the latter, a sliding or pushing mechanism is necessary to move the item into the rings. In order to insure that the item always comes to rest on the rollers in the rings during loading, the position of the slits and therefore the rollers must be chosen such that when they are in line with the loading door at the end of the chamber, the rollers are at the lowest position on the inner face of the rings.

If the transport facility is intended to handle charges of more than several tons in weight, it is preferred in the present invention, to support the shaft, which preferably rotates at one end in a fixed bearing, by means of at least one outer ring which is mounted on bearings. The outer ring is connected to the shaft for rotation therewith and rests on plurality of support rolls mounted in bearings on a support frame. The outer ring which is like a free bearing can be connected to the shaft via spokes or via the support rings. Such outer rings are provided in the requisite number spaced along the length of the shaft. If one single outer ring is adequate, then it can be placed approximately at the middle of the shaft or else where the greatest load is statistically expected to occur. It is however also possible to provide a three point support to the shaft by allowing it to rotate on a bearing, preferably a fixed bearing at one end, and over a fixed axial support ring positioned out-of-center in the direction of the other end. By means of these various kinds of bearings, the shaft can also be supported at its other end in a bearing, preferably in a free bearing, to accommodate axial expansion.

Both the cooling chamber and the shaft are preferably thermally insulated. The shaft can be in the form of a hollow shaft and can be cooled inside by the circulation of air which helps to prevent the shaft and bearings from being subjected to excessive heating.

The apparatus according to the present invention can preferably be used as an additional station in a continuous high temperature treatment line, such as is described in the Swiss Pat. No. 579,153 and in the German Pat. Nos. P 22 56 978.4 or P 23 49 765.6. In such an application the apparatus is positioned in line in the direction of material flow from the high temperature or holding furnace and in front of the quenching facility, e.g., a water spray unit. The cooling in the device of the invention during the first cooling state (in the following also denoted as "pre-cooling") can be carried out in the course of heat treatment of the item in such a way that the pre-cooling requires no extra time and does not hinder the flow of material through the high temperature treatment unit. The described pre-cooling device is arranged with its inlet door close to the outlet door of the holding furnace so that the material being treated can be transferred from the holding furnace to the cooling chamber without being subjected to an uncontrolled fall in temperature. Such an arrangement favors controlled cooling and constant quality.

The device of the present invention can be conceivably employed for other applications.

BRIEF DESCRIPTION OF THE DRAWINGS

The invention will now be explained in greater detail with reference to the following drawings in which.

FIG. 3 is a section of part of the same apparatus as shown in FIG. 1, but showing a modified ring which holds the material being treated.

FIG. 4 is a view of part of FIG. 3, sectioned along F—F.

DETAILED DESCRIPTION

Figure 1:
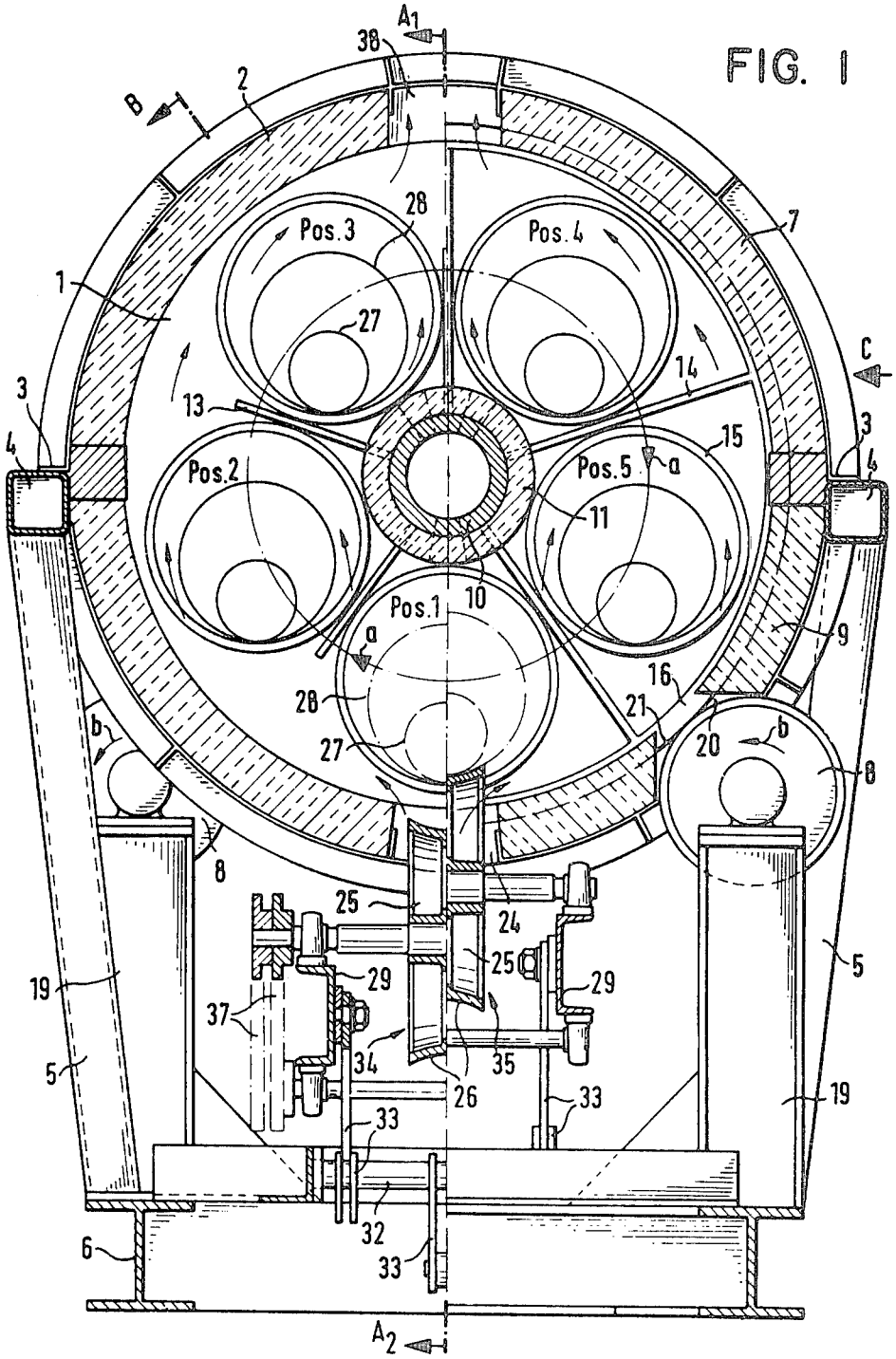
FIG. 1 is a cross section through the apparatus in accordance with the present invention, the left hand side showing the section exposed along line D—D in FIG. 2 and the right hand side showing the section along the line E—E in FIG. 2.

Referring to the drawings, the apparatus for controlled cooling or pre-cooling has a cylindrical cooling chamber 1 with a thermally insulating lining 2. The lining 2 is stationary, being held in place on both sides by flanges 3, longitudinal beam 4, and supported in the horizontal position by columns 5 on a base frame 6. The insulating material making up the lining 2 comprises mainly mineral granulate 7 and, in the region of the supporting rolls 8, whose function is still to be described, self-supporting pieces of insulation 9. Along the center of the cooling chamber 1 there is a hollow shaft 10 which is clad on the outside by a thermally insulating layer 11 and can be cooled inside by passing air through it. The hollow shaft 10 is provided with a group 12 of radial struts or spokes 13 and 14 spaced equally around the circumference of the shaft 10. Support rings 15 are fixed between the struts or spokes and are intended to support the material to be cooled. In the embodiment shown in FIGS. 1 and 2 there are five support rings at each group of struts or spokes arranged in such a manner that the rings of each group are in line with the others in a series along the length of the cooling chamber. The distance between the individual groups of rings 12 are chosen with respect to the lengths of material to be treated, such as ingots, so that the ingots are always supported by at least two rings. If the ingots are short in comparison with the length of the cooling chamber, a plurality of ingot lengths can be loaded end to end in a series of support rings.

In the embodiment shown, one of the groups of rings has longer radial spokes 14, and connects to an outer ring 16 thus securing ring 16 to the shaft 10. Alternatively, it would be possible to arrange these spokes 14 between any two groups of rings 12. Furthermore, it is also conceivable to secure the outer ring 16 only on the rings 15 of one group, i.e., without such spokes.

The hollow shaft 10 rotates in a self-aligning bearing 17, which is mounted on a yoke 18 comprising a cross-beam and two columns. The hollow shaft is also supported towards its other end via the outer ring 16 on a pair of main load-bearing rollers 8 which are rotatably mounted on supports 19. The rollers 8 contact the outer circumference 21 of the outer ring 16. In this way, a three point support is provided for the hollow shaft 10. As this shaft 10, which is driven by a chain drive 22 and a geared drive 23, rotates in the direction of the arrow a in FIG. 1, the outer circumference 21 of the outer ring 16 turns on the main load-bearing rolls 8 which in turn rotate in the direction of the arrow b in opposite sense to direction a. If necessary, additional support rings 16 can be provided in the same manner as described above at other groups of rings 12 or, between the groups. The shaft can also be supported at the right hand end by a free bearing.

Figure 2:
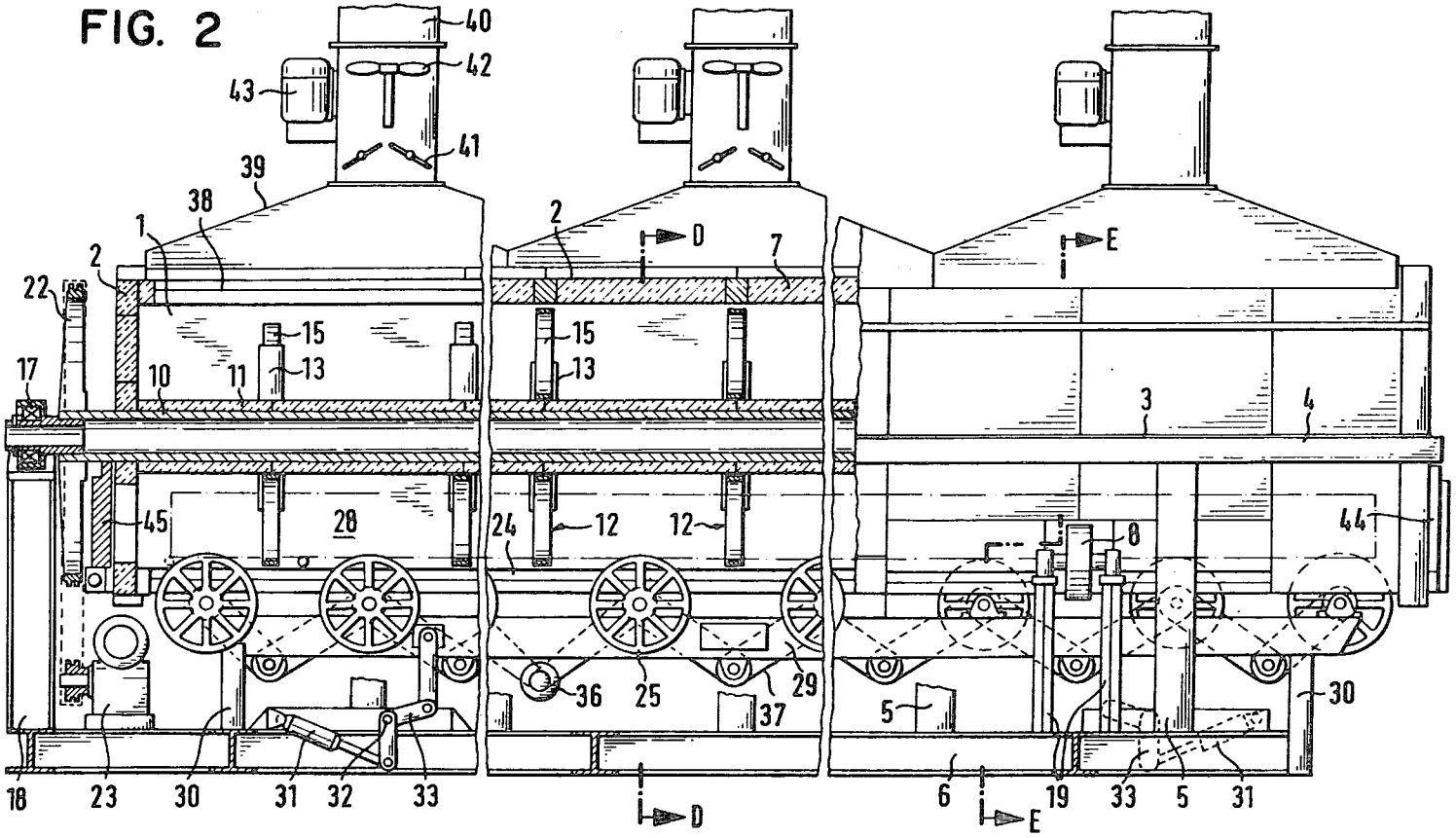
FIG. 2 is a longitudinal view of the apparatus shown in FIG. 1, partly sectioned and on a smaller scale, the left side showing a section along $A_1$–$A_2$ in FIG. 1, the center part a section along line B–$A_2$ (with the exception of the air exhaust facility), and in the right hand part a view looking in the direction of the arrow C in FIG. 1.

The cooling chamber 1 has in its lower part along its whole length a slit 24 which is at least in specific places sufficiently wide to allow a set of rollers 25 to have access to the interior of the chamber 1. The outer peripheral face 26 of the rollers 25 is in the form of an obtuse angle which is suitable for engaging billets of various diameters. The rollers 25 are mounted on bearings on arms 29 which can be raised and lowered in the vertical direction on guide rails 30 by means of a piston mechanism comprising a piston cylinder 31, a stationary axle 32 mounted on the frame, and jointed rods 33. The distance through which the rollers 25 are raised and lowered is illustrated in FIG. 1 by the roller 25 in the lower position on the left hand side of the figure, and in the upper position passing through the longitudinal slit 24 on the right hand side of the same figure. In the raised position, which is also shown in FIG. 2, the uppermost part of the working face of the rollers 25 and therefore the lowest part of the round billets 27 and 28 resting thereon are above the lowest part of the inner circumference of the rings 15 in a position just above the longitudinal slit 24. The set of rollers 25 is driven by a combined motor 36 and chain drive 37. It is sufficient that only some of the rollers 25 be power driven. The lower longitudinal slit 24 serves as the inlet for the cooling medium, preferably air from the surrounding atmosphere. At the top of the cooling chamber 1 there is another longitudinal slit 38 in the outer lining 2 and insulation 7 which serves as the outlet for the cooling medium. At least one exhaust facility is provided above this slit. In the preferred embodiment of the present invention, there is a total of three such facilities with hoods 39 arranged over the whole length of the chamber 1 and tapering towards suction pipes 40. A flap 41 is provided in each of the pipes 40 to allow the force of suction and therefore coolant throughput to be reduced. A sliding door could also be provided. Also provided in each pipe 40 is a fan 42 driven by an electric motor 43. The fans 42 and flaps 41 allow the air to be sucked in through the slit 24 at the bottom of the chamber 1 and pass through chamber 1 as indicated by the arrows in FIG. 1 flowing over the contents uniformly, which allows for cooling the charge uniformly, and to leave the chamber 1 through slit 38. The flow of air for cooling the charge can be regulated as required by adjusting the fans 42 and/or the position of the flaps 41. In the case of natural draught in particular, the necessary adjustment required for ingots of different size (diameter and/or length) is possible by controlling the time the ingots spend in the cooling chamber. This control is achieved by changing the running speed of the drive 22 and 23 to turn the shaft 10 and support rings 15, thus altering the length of time the round ingots 27/28 are in the chamber 1. The billets pass through positions 1, 2, 3, 4, 5 in FIG. 1 until they arrive again at position 1 just above the longitudinal slit 24. If a single rotation of the charge round the central axis is too brief for the desired cooling effect, or would cause the material to warp, then there is nothing to prevent a further one or more rotations from being carried out. The speed at which the hollow shaft 10 rotates can be adjusted in such a way that one rotation of the unit suffices to achieve the desired cooling effect.

The temperature of the material being treated can be monitored with a thermocouple or pyrometer and the cooling conditions modified (air throughput/speed of rotation) for any particular type of item to be treated. Usually random checks on the material leaving the chamber are sufficient to decide whether any corrections, e.g., to air flow rate are necessary.

The rings 15 are loaded by means of the set of rolls via the chamber door 44 (at the right in FIG. 2) which can be used both for loading and unloading the round billets. Of course, by providing a further door 45 at the left hand end of the cooling chamber in FIG. 2, the material can be unloaded at the other end of the unit. This is a feature which is particularly useful when the cooling facility stands immediately in line with a holding furnace.

If the material being treated is to be rotated only once in the cooling chamber, and if all five sets of rings are to be loaded, after each rotation through 72°, the shaft 10 must come to a halt briefly in order to allow unloading of the cooled billet and reloading with a billet which is to be cooled. This mode of operation is preferred in order to utilize fully the capacity of the facility.

The ring-shape of the supports 15 for holding the billets ensures that, during rotation about the center shaft 10 in the chamber, the billets always roll into the lowest position in the rings 15. This progressive rotation of the hot billets prevents them from warping during cooling; for this reason a plurality of turns around the chamber can also be of advantage.

Instead of raising and lowering the charge with the rollers 25 as illustrated in FIGS. 1 and 2 an arrangement of rollers such as shown in FIGS. 3 and 4 can be employed.

As can be seen in FIGS. 3 and 4, each ring 15 is provided with a slit 46 which is delimited on both sides by flanges 47 formed by bending the parts of the ring 15 outwards. The flanges 47 serve as bearings for a roller 48 which fills the slit 46 in such a way that its outer circumference 49 has the same curvature as the inner face 50 of the ring and is aligned with this face 50. The roller 48 can be driven by a chain drive facility 53 where the last or first cogged wheel 51 is connected to a power driven shaft, which has at one end a square shaped head which can be engaged by a transmission shaft in the loading position via a door or some other opening in the cooling chamber.

In the embodiment shown in FIGS. 3 and 4, the material to be treated is as is the case in the first version, introduced via a door 44 into the various groups of aligned rings 15. In the embodiment shown in FIG. 3 the loading and unloading position is approximately the same as position 2 of the embodiment shown in FIG. 1, i.e., at the side of the hollow shaft, so that the rollers and their drive mechanism are situated in the free space available between two rings and the cooling chamber.

Of course the rollers 48 can also be arranged at another part of the rings 15 and if necessary a greater distance can be provided between the rings 15 and the wall 2. It is important however that in the loading position the rollers 48 are always in the lower part of the rings 15. In this way, the billets 27 and 28 can be loaded into the cooling chamber 1 without much friction. Because of the good alignment with the inner face 50 of the rings 15, the slit 46 and the rollers 48 cause almost no interference with the rotation of the billets in the rings 15 as the shaft 10 rotates. It is possible however to mount the rollers 48 as free running, non-driven rolls in the slit 46. An extra device (not shown here) is then required to push the billets.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for use in cooling heated material such as extrusion billets or the like comprising:

a cooling chamber having material inlet means and material outlet means, said chamber including means for transporting said material within said cooling chamber;

said transporting means includes a substantially horizontal shaft means rotatably mounted within said cooling chamber and further including a plurality of support means disposed axially in spaced apart relationship along said shaft means;

each of said support means comprises a plurality of substantially ring shaped material support members radially disposed about said shaft means so that each support member of each support means is aligned with a corresponding support member on another of said support means; and coolant medium inlet means and coolant medium outlet means associated with said cooling chamber for the ingress and egress of a cooling medium so as to bring said cooling medium in contact with said material to be cooled.

2. An apparatus according to claim 1 further including means associated with said cooling chamber for selectively controlling the throughput of coolant medium in said cooling chamber.

3. An apparatus according to claim 2 wherein said means for controlling said coolant medium throughput comprises a blower.

4. An apparatus according to claim 2 wherein said means for controlling said coolant medium throughput comprises flaps.

5. An apparatus according to claim 2 wherein said means for controlling said coolant medium throughput comprises a sliding door.

6. An apparatus according to claim 2 wherein said means for controlling said coolant medium throughput is associated within said coolant medium outlet means.

7. An apparatus according to claim 1 including motor means adapted to rotate said shaft means, and further including means for adjusting the speed of rotation of said shaft.

8. An apparatus according to claim 1 wherein each of said support members is in the form of a ring.

9. An apparatus according to claim 1 wherein each of said support means further comprises a plurality of support struts radially disposed about said shaft means wherein each of said support members is disposed between two of said plurality of support struts.

10. An apparatus according to claim 1 wherein said coolant medium inlet means comprises a longitudinal slot at the bottom of said cooling chamber and extending substantially the entire length thereof.

11. An apparatus according to claim 10 further including roller means associated with said slot, said roller means being adapted to feed said material into said support members.

12. An apparatus according to claim 8 wherein each ring is provided with a slit adapted to receive a roller, the axis of rotation of said roller being perpendicular to the axis of said ring, said roller having a circumferential surface whose radius of curvature is substantially identical to that of said ring so as to form therewith a substantially smooth surface.

13. An apparatus according to claim 1 wherein said shaft means is supported by a plurality of bearings, at least a first bearing means provided on the end of said shaft means exterior of said cooling chamber and a second bearing means axially spaced from said first bearing means and located within said chamber.

14. An apparatus according to claim 13 wherein said second bearing means comprises a ring defining in part said cooling chamber, said ring being mounted for rotational movement in said cooling chamber.

15. An apparatus according to claim 14 wherein said ring is adapted to roll on bearing support means located exterior of said cooling chamber.

16. An apparatus according to claim 14 including a plurality of support struts secured to and radially disposed about said shaft means wherein said ring is secured to at least one of said support struts.

17. An apparatus according to claim 14 wherein said ring is mounted on at least one of said support members.

18. An apparatus according to claim 1 wherein said shaft means and said cooling chamber are thermally insulated.

19. An apparatus according to claim 1 wherein said shaft means is hollow and further includes means for circulating a cooling medium through said shaft means.

20. An apparatus according to claim 1 further including a holding furnace located in line with and immediately upstream of said material inlet means.

* * * * *